US011041503B2

(12) United States Patent
Iurisci et al.

(10) Patent No.: US 11,041,503 B2
(45) Date of Patent: Jun. 22, 2021

(54) HIGH STIFFNESS TURBOMACHINE IMPELLER, TURBOMACHINE INCLUDING SAID IMPELLER AND METHOD OF MANUFACTURING

(71) Applicant: NUOVO PIGNONE TECNOLOGIE SRL, Florence (IT)

(72) Inventors: Giuseppe Iurisci, Florence (IT); Simone Corbo, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 34 days.

(21) Appl. No.: 15/759,838

(22) PCT Filed: Sep. 14, 2016

(86) PCT No.: PCT/EP2016/071652
§ 371 (c)(1),
(2) Date: Mar. 14, 2018

(87) PCT Pub. No.: WO2017/046135
PCT Pub. Date: Mar. 23, 2017

(65) Prior Publication Data

US 2018/0266433 A1 Sep. 20, 2018

(30) Foreign Application Priority Data

Sep. 15, 2015 (IT) ..... 102015000051769

(51) Int. Cl.
*F04D 29/28* (2006.01)
*F04D 17/12* (2006.01)
(Continued)

(52) U.S. Cl.
CPC ..... *F04D 29/284* (2013.01); *F04D 17/02* (2013.01); *F04D 17/122* (2013.01); *F04D 29/285* (2013.01); *F04D 29/30* (2013.01)

(58) Field of Classification Search
CPC ..... F04D 29/284; F04D 29/286; F04D 29/30; F04D 29/285; F04D 29/329;
(Continued)

(56) References Cited

U.S. PATENT DOCUMENTS 3,904,308 A 9/1975 Ribaud
4,502,837 A 3/1985 Blair et al.
(Continued)

FOREIGN PATENT DOCUMENTS

CN 101135318 A 3/2008
CN 101586581 A 11/2009
(Continued)

OTHER PUBLICATIONS

Italian Search Report and Written Opinion issued in connection with corresponding IT Application No. 102015000051769 dated Aug. 3, 2016.
(Continued)

*Primary Examiner* — Kenneth J Hansen
*Assistant Examiner* — Maxime M Adjagbe
(74) *Attorney, Agent, or Firm* — Baker Hughes Patent Organization

(57) ABSTRACT

A turbomachine impeller is disclosed, which includes: a hub having a rotation axis; a shroud; a plurality of blades between the hub and the shroud; and a plurality of flow vanes, each flow vane being defined between the hub, the shroud and neighboring blades, each flow vane having a flow vane inlet and a flow vane outlet. Each flow vane extends radially inwardly from the flow vane inlet towards a radially innermost flow vane section, and from the radially innermost flow vane section to a flow vane outlet.

15 Claims, 11 Drawing Sheets

(51) Int. Cl.
*F04D 17/02* (2006.01)
*F04D 29/30* (2006.01)

(58) Field of Classification Search
CPC .. F04D 29/328; F04D 29/324; F04D 29/2216; F04D 17/122; F04D 17/02
See application file for complete search history.

(56) References Cited

U.S. PATENT DOCUMENTS

| | | | | |
|---|---|---|---|---|
| 5,105,616 | A | 4/1992 | Bornemisza | |
| 6,164,931 | A | 12/2000 | Norton et al. | |
| 7,628,586 | B2 * | 12/2009 | Feher | B23P 15/006 415/170.1 |
| 8,845,268 | B2 | 9/2014 | Nikpour | |
| 2010/0232953 | A1 | 9/2010 | Anderson | |
| 2014/0169971 | A1 * | 6/2014 | Vedula | F04D 29/023 416/185 |

FOREIGN PATENT DOCUMENTS

| | | | |
|---|---|---|---|
| CN | 204200679 | U | 3/2015 |
| EP | 05671231 | A1 | 10/1993 |
| EP | 2746589 | A2 | 6/2014 |
| JP | 2015040505 | A | 3/2015 |
| WO | 2009/138445 | A1 | 11/2009 |
| WO | 2015041174 | A1 | 3/2015 |

OTHER PUBLICATIONS

International Search Report and Written Opinion issued in connection with corresponding PCT Application No. PCT/EP2016/071652 dated Oct. 21, 2016.

International Preliminary Report on Patentability issued in connection with corresponding PCT Application No. PCT/EP2016/071652 dated Mar. 20, 2018.

* cited by examiner

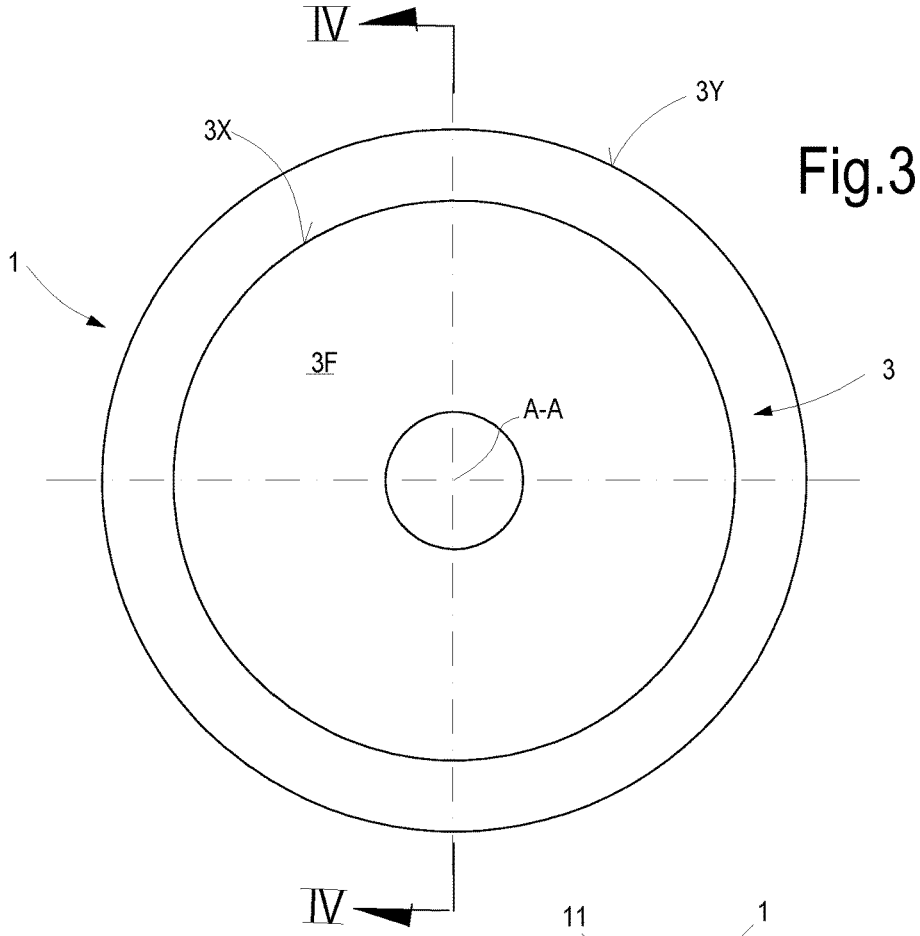
Fig.3
Fig.4
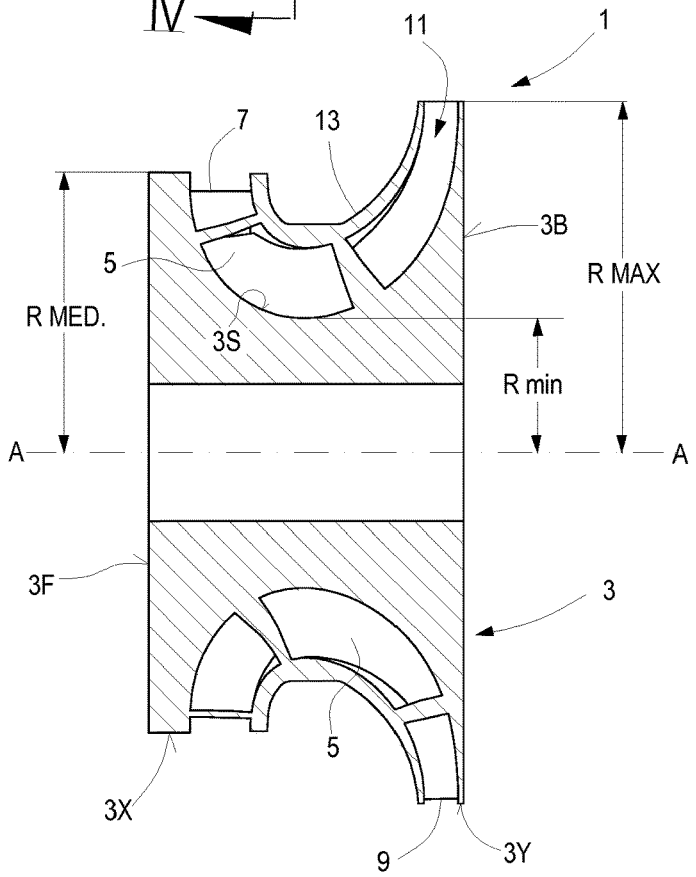

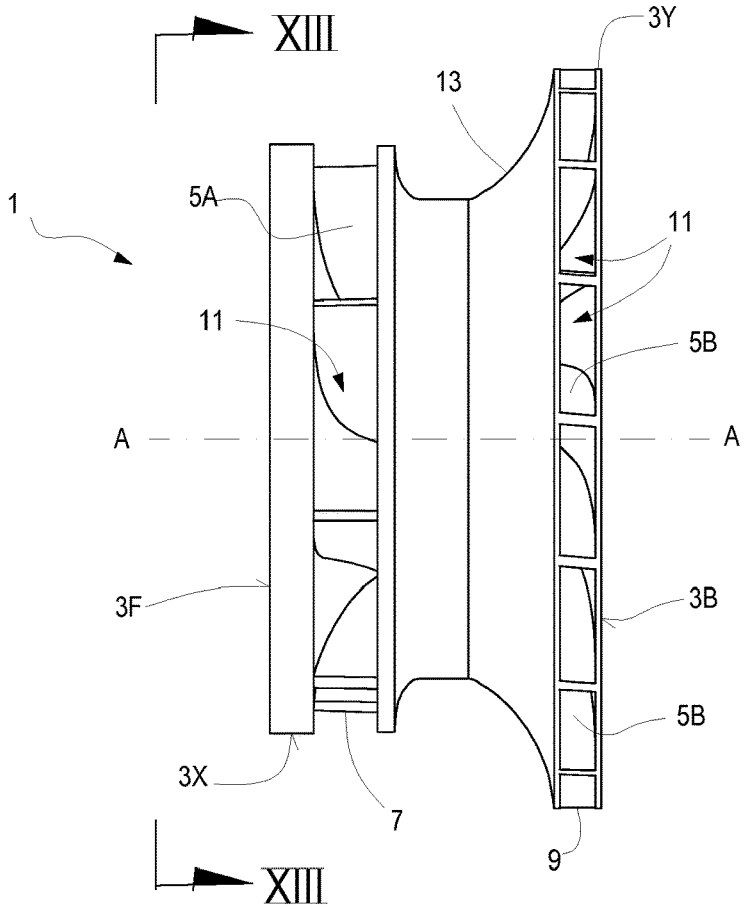
Fig.11
Fig.12
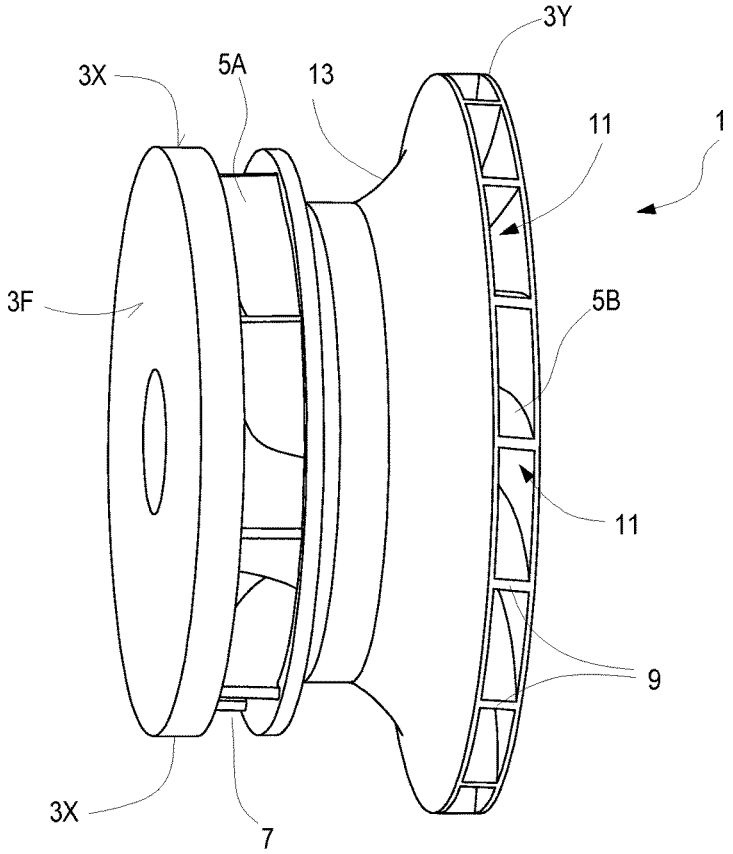

Fig.16
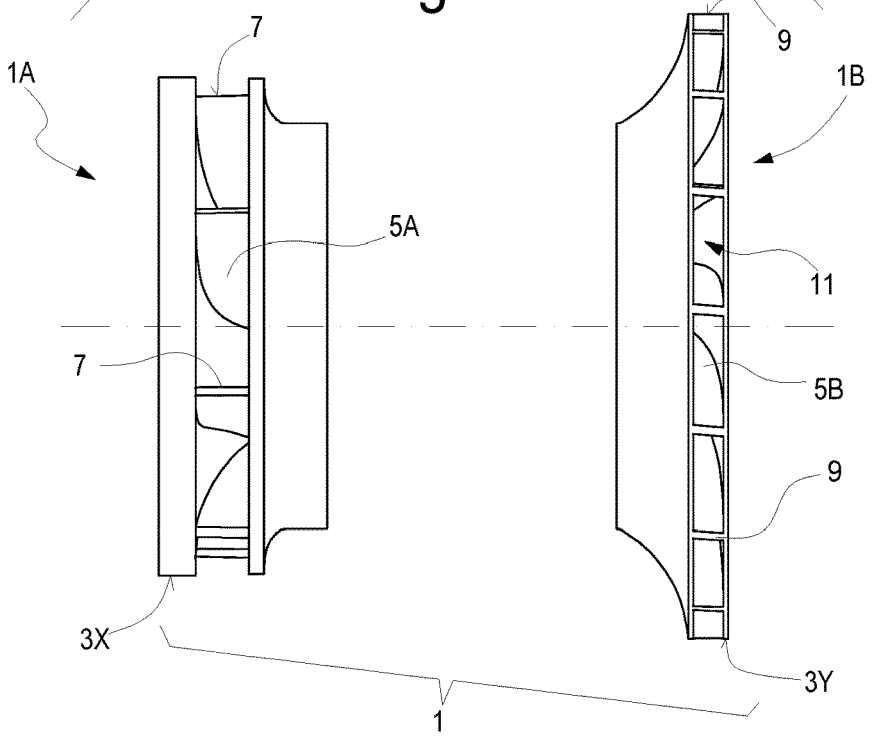
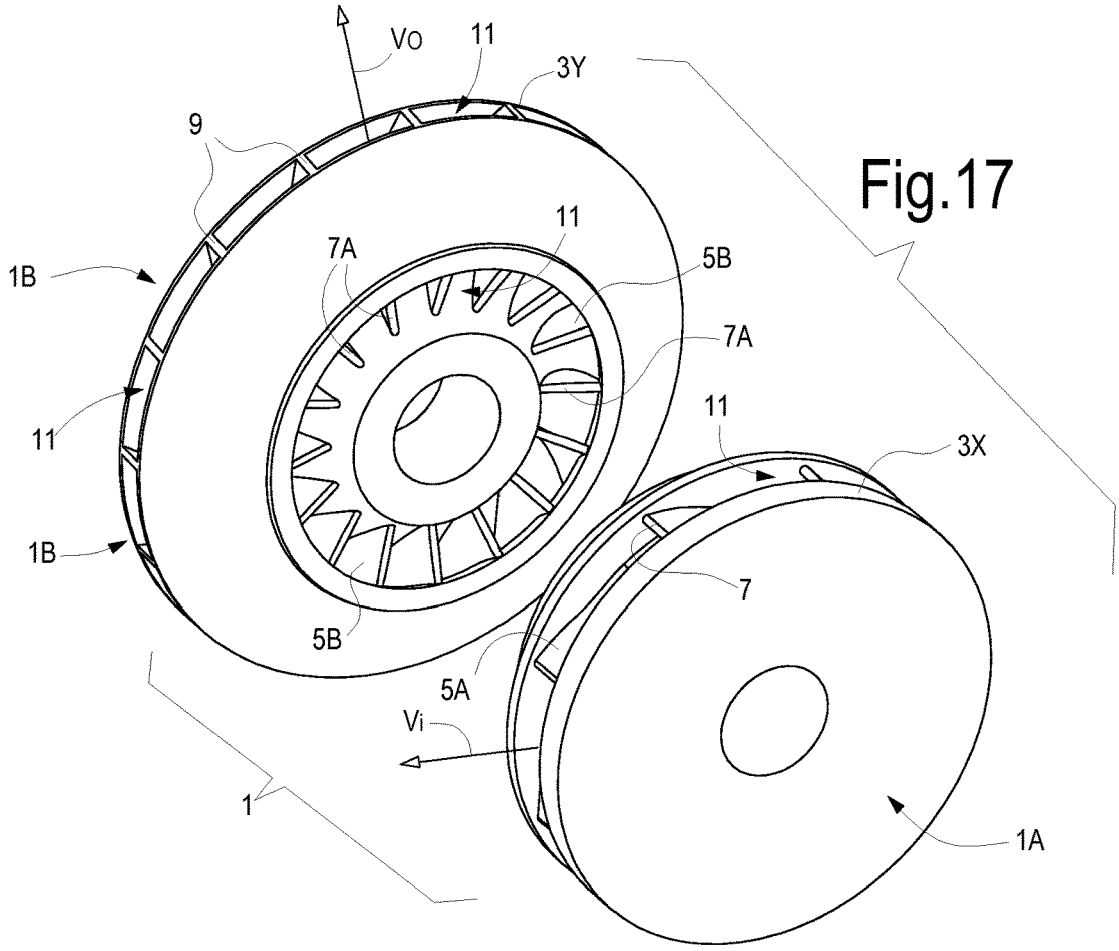
Fig.17

HIGH STIFFNESS TURBOMACHINE IMPELLER, TURBOMACHINE INCLUDING SAID IMPELLER AND METHOD OF MANUFACTURING

TECHNICAL FIELD

The disclosure in general relates to turbomachines and impellers thereof. Embodiments disclosed herein refer to so-called shrouded impellers.

BACKGROUND OF THE INVENTION

Radial or mixed turbomachines usually comprise one or more impellers arranged for rotation in a casing. Each impeller is comprised of a hub having a front surface, a back surface and a side surface therebetween. The impeller further comprises a plurality of blades extending from a blade root on the side surface of the hub towards a blade tip.

Shrouded impellers are known, wherein blades are arranged between the hub and an outer shroud surrounding the hub and rotating therewith. The blade tips are connected to an inner surface of the shroud. Flow vanes between the shroud, the hub and pairs of neighboring blades are thus defined. The shroud improves the stiffness of the impeller blades.

The impellers are usually mounted on a shaft, forming a turbomachine rotor, which is arranged for rotation in a stationary casing of a turbomachine. The turbomachine rotor exhibits natural frequencies, also called resonance frequencies. When a natural frequency is at or close to a forcing frequency, such as the rotor speed, resonant vibration occurs. The critical speed of a rotating machine is the rotational speed which matches the natural frequency of the rotating machine. The lowest speed at which the first natural frequency is encountered is called first critical speed. As the rotational speed increases, additional critical speeds are encountered. Machine vibrations amplitude increases when a natural frequency is achieved. Resonance vibrations can cause failure due to high cycle fatigue.

When designing a turbomachine rotor, one of the critical aspects is to optimize the rotor dynamics thereof, by reducing vibration amplitudes when a critical speed is approached, and increasing the stiffness of the rotor, thus increasing the natural speeds, such that the operation speed remains below the natural speeds of the turbomachine rotor and/or that the rotor passes safely through the critical speeds when in acceleration or deceleration.

It is thus desirable to improve the stiffness of a turbomachine rotor, in order to improve its rotor dynamic behavior.

SUMMARY OF THE INVENTION

According to some aspects, disclosed herein is a turbomachine impeller, comprising a hub, a shroud and a plurality of blades arranged between the hub and the shroud, and having a rotation axis. The turbomachine impeller further comprises a plurality of flow vanes, each flow vane being defined between the hub, the shroud and neighboring blades. Each flow vane has a flow vane inlet located between respective first edges of two neighboring blades, and a flow vane outlet located between respective second edges of two neighboring blades. A inlet surface is defined between the first edges, and a outlet surface is defined between the second edges. The inlet and outlet surfaces can be planar geometrical surfaces. The inlet and outlet surfaces span across the respective flow vane from one to the other of said two first edges and second edges, respectively. A vector orthogonal to the inlet surface and facing outwardly the flow vane and a vector orthogonal to the outlet surface and facing outwardly the flow vane can be further be defined. Each said vectors has an outwardly oriented vector component, which is orthogonal to the rotation axis of the impeller.

The subject matter disclosed herein further concerns a turbomachine impeller with a rotation axis and comprising: a hub; a shroud; a plurality of blades arranged between the hub and the shroud; a plurality of flow vanes, each flow vane being defined between the hub, the shroud and neighboring blades, each flow vane having a flow vane inlet located between respective first edges of two neighboring blades, and a flow vane outlet located between respective second edges of two neighboring blades. Each flow vane extends radially inwardly from the flow vane inlet towards a radially innermost flow vane section, and from the radially innermost flow vane section radially outwardly to a flow vane outlet.

Each flow vane can be configured and arranged such that fluid flow in the flow vane inlet has a radially inwardly oriented flow speed component and fluid flow in the flow vane outlet has a radially outwardly oriented flow speed component.

As will become apparent from the following description of some embodiments of the impeller according to the present disclosure, the radial extension of the flow vanes results in a more rigid overall structure of the impeller, which has positive effects on the resonance frequency of the single impeller, as well as of a rotor comprised of a plurality of stacked impellers.

According to some embodiments, the hub comprises a front disk portion, a back disk portion and an intermediate hub portion extending therebetween. The blades are arranged between the front disk portion and the back disk portion. The intermediate hub portion has a minimum radial dimension, which is smaller than the radial dimension of both the front disk portion and the back disk portion.

The shroud can have a portion of minimum radial dimension, the diameter whereof is not smaller than the diameter of at least one of the back disk portion and front disk. In this manner, the shroud can be manufactured separately from a hub unit, which is comprised of the front disk portion, back disk portion, intermediate hub portion and blades. The shroud can be mounted around the hub unit and connected thereto, e.g. by welding, gluing, soldering, or by any other suitable means.

In some embodiments, each blade can extend from the inlet to the outlet of the flow vane. In other embodiments, the blades can be shorter than the flow vanes across the impeller. Each flow vane can then be defined by sequentially arranged blades belonging to different sets of blades. For instance, two sets of sequentially arranged blades can be provided, the blades of a first set extending from the flow vane inlets to an intermediate section of the flow vanes, and the blades of a second set extending from the intermediate section to the flow vane outlets. The first set of blades and the second set of blades can contain the same number of blades or different numbers of blades. For instance one set can comprise twice the number of blades of the other set.

In embodiments disclosed herein, at least the first blade edges or the second blade edges are oriented such that the projections thereof on a meridian plane of the impeller are substantially parallel to the rotation axis. The other of said first blade edges and second blade edges can be oriented such that the projections thereof on a meridian plane form with the rotation axis an angle between about 0° and about 60° and in an embodiment, between about 0° and about 45°, or more particularly between about 0° and about 30°. In other embodiments, both the first blade edges and the second blade edges are oriented such that the projections thereof on a meridian plane form with the rotation axis of the impeller an angle of about 0°, or comprised between about 0° and about 60°, in an embodiment between about 0° and about 45° and more particularly between about 0° and about 30°.

According to a further aspect, disclosed herein is a turbomachine comprising a casing and at least a first impeller as disclosed herein. In some embodiments, the turbomachine is a multi-stage turbomachine, including a plurality of sequentially arranged impellers, for instance stacked to one another thus forming a rotor arranged for rotation in a stationary turbomachine casing. A diffuser and a return channel can be arranged between each pair of sequentially arranged first impeller and second impeller, and the flow vane inlets of the second impeller face an outlet of the return channel.

According to yet another aspect, a method for manufacturing a turbomachine impeller of the above mentioned art is disclosed, wherein the hub, the blades and the shroud are produced monolithically in a single additive manufacturing process.

In a different embodiment, a method of manufacturing a turbomachine impeller of the above mentioned art can comprise the following steps: producing a hub and a plurality of blades as a single piece, each blade extending from a blade root, at the hub, to a blade tip; arranging a shroud around the blades and substantially coaxially to the hub; connecting the shroud to blade tips.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of embodiments of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of embodiments of the present invention. It is important, therefore, that the claims be regarded as including such equivalent constructions insofar as they do not depart from the spirit and scope of embodiments of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein:

FIG. 3 illustrates a front view according to line III-III of FIG. 1;

FIG. 4 illustrates a section according to line IV-IV of FIG. 3;

FIG. 11 illustrates a side view of a further embodiment of an impeller according to the present disclosure;

FIG. 12 illustrates an axonometric view of the impeller of FIG. 11;

FIG. 16 illustrates a further exemplary embodiment of an impeller according to the present disclosure in a side view and in a pre-assembled condition;

FIGS. 17 and 18 illustrate axonometric views of the impeller of FIG. 16;

DETAILED DESCRIPTION

Figure 1:
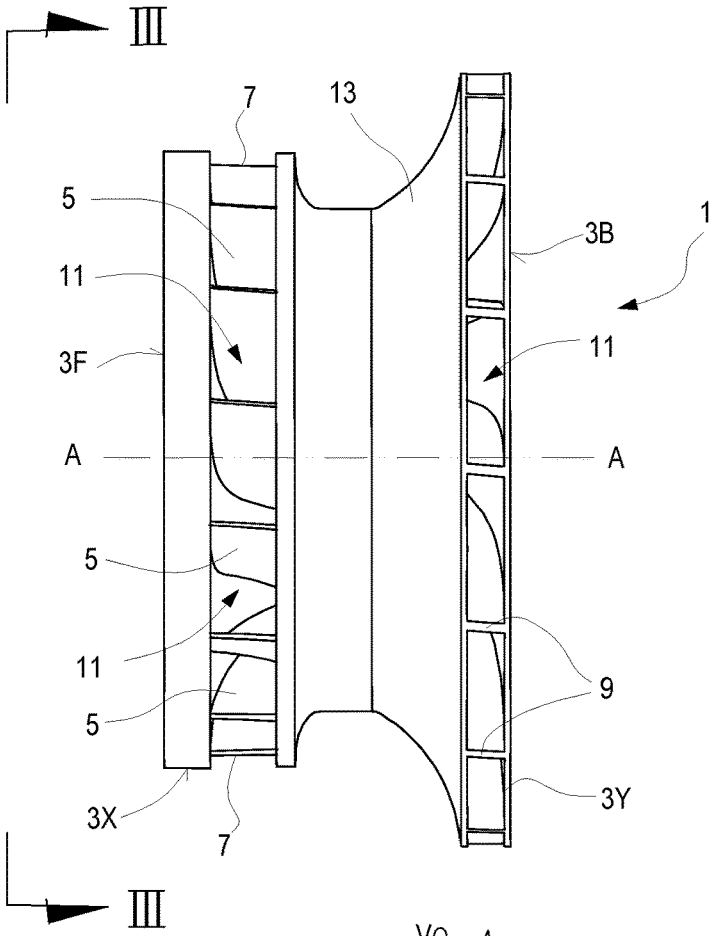
FIG. 1 illustrates a side view of an exemplary embodiment of an impeller according to the present disclosure.

The following detailed description of exemplary embodiments refers to the accompanying drawings. The same reference numbers in different drawings identify the same or similar elements. Additionally, the drawings are not necessarily drawn to scale. Also, the following detailed description does not limit embodiments of the invention. Instead, the scope of embodiments of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

As will be described herein below, a novel impeller design is suggested, aimed at improving the impeller rigidity and thus the overall rigidity of a turbomachine rotor including one or more impellers. Rigidity is improved by extending the impeller blades in a radial and axial direction, such as to arrange both the leading edge and the trailing edge of the blades at a distance from the rotation axis of the impeller. The hub of the impeller is radially extended at both a front end and at a back end to provide more support to the blades. The overall structure of the impeller and of the rotor is made more rigid, thus improving the rotor dynamic thereof. Referring now to FIGS. 1 to 5, an impeller 1 for a radial turbomachine generally comprises a hub 3, having a rotation axis A-A. The hub 3 has a front end 3F, a back end 3B and a side surface 3S extending between the front end 3F and the back end 3B. A plurality of blades 5 are provided, each extending from a blade root located on the side surface 3S of the hub 3 and projecting therefrom.

In the embodiment of FIGS. 1-5 each blade 5 is comprised of a first blade edge 7 and a second blade edge 9. Each blade 5 has opposing pressure side and suction side, extending between the first blade edge 7 and the second blade edge 9. Between each pair of adjacent, i.e. consecutive or neighboring blades 5, a flow vane 11 is defined. Each flow vane 11 is further delimited by a portion of the side surface 3S of hub 3 and a portion of an inner surface of a shroud 13, which is arranged coaxial to the hub 3 and connected thereto by the blades 5, each blade extending from the respective blade root, located at the side surface 3S of the hub 3, to a respective blade tip located at the shroud 13.

During operation, a working fluid processed through the impeller flows through the flow vanes 11 from a flow vane inlet to a flow vane outlet. If the impeller 1 is a centrifugal machine impeller, e.g. a centrifugal pump impeller or a centrifugal compressor impeller, the first blade edge 7 is the leading edge and the second blade edge 9 is the trailing edge of the blade. The fluid processed through the impeller 1 flows along each flow vane 11, from a flow vane inlet located between the first or leading edges 7 of neighboring blades 5, to a flow vane outlet located between the second or trailing edges 9 of said neighboring blades 5.

In a centripetal machine, the fluid flow is reversed, from the second edges 9 to the first edges 7. The second edges 9 are in this case be the leading edges and the first edges 7 are the trailing edges of the blades 5. Each flow vane 11 has a flow vane inlet defined between the second, leading edges 9, and a flow vane outlet defined between the first, trailing edges 7.

Turning now to the exemplary embodiment of FIGS. 1 to 5, each blade 5 extends from the flow vane inlet, where the leading edges 7 are located, to the flow vane outlet, where the trailing edges 9 are arranged. However, as will be described later on with respect to further exemplary embodiments, the impeller 1 can be provided with a plurality of blade sets, for instance two blade sets, one extending from the flow vane inlets to an intermediate section of the impeller, and the other extending from the intermediate section of the impeller to the flow vane outlets.

Figure 5:
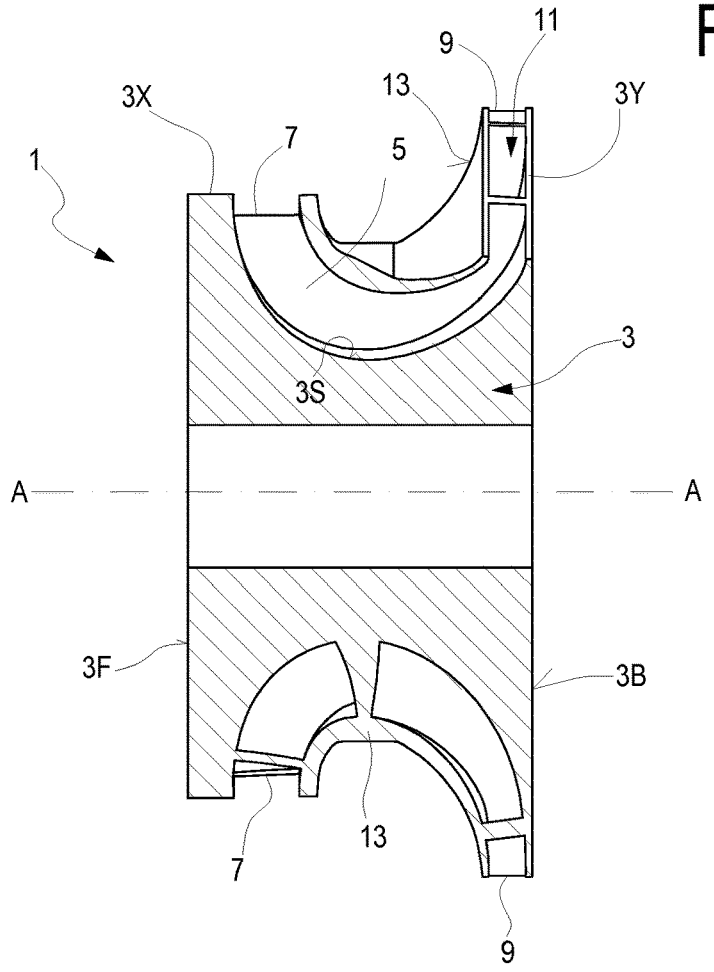
FIG. 5 illustrates a further sectional view similar to FIG. 4.

As best shown in FIGS. 4 and 5, according to some embodiments the hub 3 has a front disk portion 3X and a back disk portion 3Y, as well as an intermediate hub portion, located between the front disk portion 3X and the back disk portion 3Y. The blades 5 are arranged between the front disk portion 3X and the back disk portion 3Y. The intermediate hub portion has a minimum radial dimension Rmin. The flow vanes 11 have thus a variable radial distance from the rotation axis A-A of the impeller 1. The smallest radial distance of each flow vane 11 is located in the intermediate hub portion. Starting from the smallest radial distance, each flow vane extends radially outwardly towards the first edges 7 and the second edges 9 of the respective blades 5, which delimit the flow vane 11.

Both the front disk portion 3X and the back disk portion 3Y have a radial dimension greater than the minimum radial dimension Rmin of the hub 3. In the exemplary embodiment of FIGS. 1 to 5, the back disk portion 3Y has a radial dimension RMAX which is larger than a radial dimension RMED of the front disk portion 3X.

Each flow vane 11, therefore, extends radially inwardly from the flow vane inlet, at the leading edges 7, towards a radially innermost flow vane section, located at the portion of minimum radial dimension Rmin of the hub 3, and from the radially innermost flow vane section to flow vane outlet, at the trailing edges 9.

The radial dimension RMED can be substantially equal to radial dimension of the shroud 13 at the impeller inlet (see in particular FIG. 4). The first blade edges 7 can thus lie on a substantially cylindrical surface, coaxial to the hub 3, i.e. co-axial to the rotation axis A-A of the impeller 1. The first blade edges 7 can extend substantially parallel to the rotation axis A-A, or their projection on a meridian plane will be parallel to the rotation axis A-A, the meridian plane being a plane containing the rotation axis A-A.

Similarly, the second blade edges 9, or trailing edges 9, can be arranged on a substantially cylindrical surface coaxial to the hub 3, i.e. to the rotation axis A-A of the impeller 1. The second blade edges 9 can extend substantially parallel to rotation axis A-A, or their projection on a meridian plane can be substantially parallel to rotation axis A-A, as shown in FIGS. 4 and 5.

In the exemplary embodiments shown herein, the first blade edges 7 and the second blade edges 9 are rectilinear. This, however, is not mandatory. Either the first blade edges 7, or the second blade edges 9, or both the first blade edges 7 and the second blade edges 9 can have a curved shape. In this case the projection of the first or second blade edges on the meridian plane will not be a straight line. The above mentioned orientation with respect to the rotation axis A-A of the blade edge projection can in this case be referred to a straight line connecting the end points of the curved projection of the blade edge on the meridian plane, the end points corresponding to the point of the edge at the root and at the tip of the blade, respectively.

Figure 2:
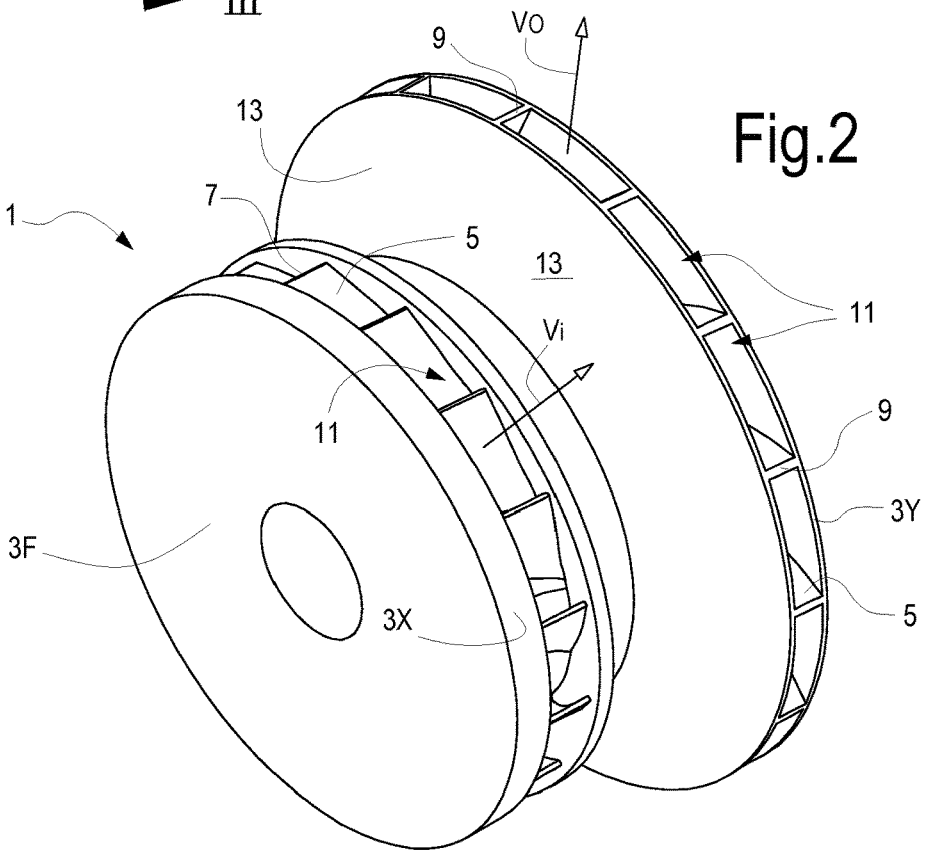
FIG. 2 illustrates an axonometric view of the impeller of FIG. 1.

At each flow vane inlet an inlet surface can be defined. In the exemplary embodiment shown in FIGS. 1 to 5, since each flow vane inlet is defined by a respective pair of neighboring first edges 7 of the blades 5, each inlet surface is a geometrical surface spanning between said pair of neighboring first edges 7. If the first edges 7 are rectilinear, the inlet surface is planar. In FIG. 2 Vi designates a geometrical vector orthogonal to the inlet surface and oriented outwardly of the flow vane 11. In this embodiment, the vector Vi is radially oriented, i.e. it has only a radial component orthogonal to the rotation axis A-A of the impeller 1 and oriented radially outwardly. The vector Vi will be referred to as inlet surface vector.

Similarly, at the opposite end of the flow vanes 11, an outlet surface can be defined as a geometrical surface spanning between two neighboring second edges 9 defining the respective flow vane outlet. If the second edges 9 are rectilinear, the outlet surface can be planar. A vector orthogonal to the outlet surface and oriented outwardly with respect to the flow vane 11 can be defined. Such vector is shown schematically in FIG. 2 and labeled Vo. The vector Vo is radially oriented, i.e. it has only a radial component orthogonal to the rotation axis A-A of the impeller 1 and oriented radially outwardly. The vector Vo will be referred to as outlet surface vector.

If the first edges 7 and/or the second edges 9 are not rectilinear, the inlet surface and/or the outlet surface are curved rather than planar. In each point of such a curved inlet or outlet surface, a tangential plane can be defined. A geometrical vector oriented outwardly of the flow vane 11 and orthogonal to the tangential plane can be defined for each point of the curved inlet and/or outlet surface. The inlet surface vector Vi and the outlet surface vector Vo are in this case the outwardly oriented vectors (i.e. the vectors oriented outwardly with respect to the respective flow vane 11) orthogonal to the plane tangent to the midpoint of the inlet surface and of the outlet surface, respectively. These inlet surface vector and outlet surface vector have again an outwardly oriented, radial vector component, orthogonal to the rotation axis A-A of the impeller 1.

As can be appreciated from the sectional view of FIGS. 4 and 5, in the impeller 1 according to the present disclosure the hub 3 extends in a radial direction at both the front disk portion 3X and back disk portion 3Y thereof, providing a stronger support for the blades 5. A stiffer structure of the impeller 1 is thus obtained. Differently from current art centrifugal compressors, the leading edges 7 are arranged in a position which is displaced radially outwardly with respect to the position of minimum radial dimension of the hub 3. The blades 5 thus extend along an impeller portion extending from the minimum radial hub dimension towards the impeller inlet. The blade roots extend radially outwardly from the section of minimum radial dimension of the hub 3 (Rmin) along the front disk portion 3X.

In the exemplary embodiment of FIGS. 1 to 5, the blades 5 extend radially towards the impeller inlet, such that the first edges 7 are located on a cylindrical surface co-axial to the hub 3.

When a plurality of impellers 1 are assembled to form a rotor, a better rotor dynamic is obtained, thanks to the improved rigidity of the rotor structure. Calculations have shown that an increase around 140-150% of the first and second natural frequencies can be achieved with respect to natural frequencies of current rotors. An even higher increase of around 170-180% can be obtained for the third natural frequency over the current art impellers.

Figure 5A:
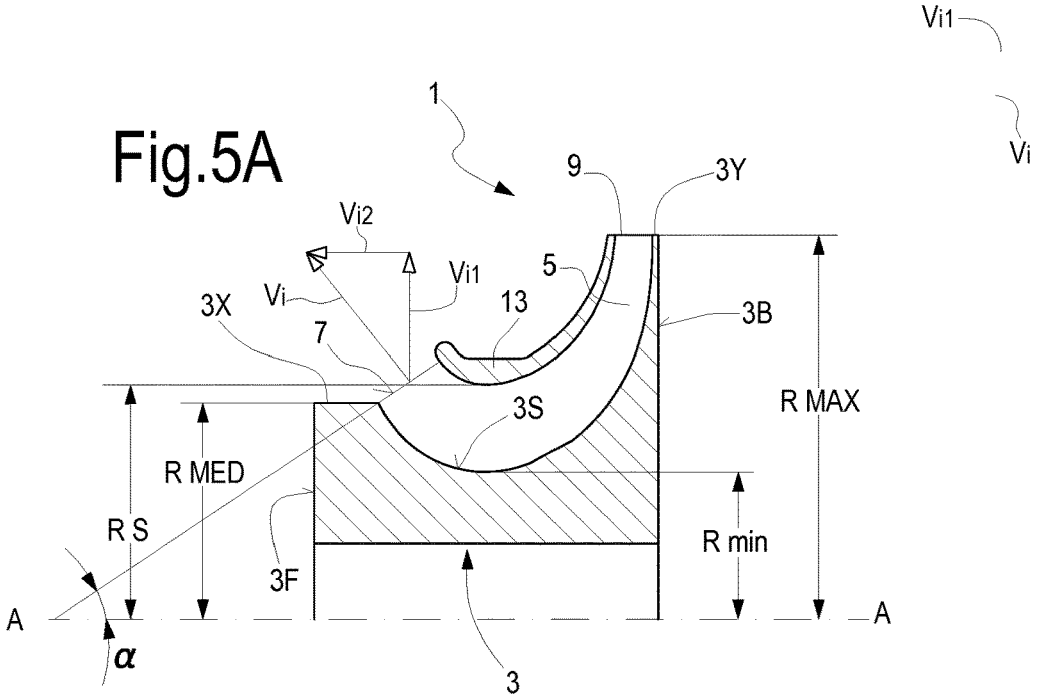
FIG. 5A illustrates a modified embodiment of an impeller according to the present disclosure, in a partial sectional view.

According to other embodiments, the radial dimension of the front disk portion 3X of the hub 3 and the extension of the blades 5 along the front disk portion 3X can be less than the one shown in FIGS. 1 to 5, where the first edges 7 come to lie on a cylindrical surface co-axial to the rotation axis A-A of the impeller 1. For instance, FIG. 5A illustrates a modified embodiment of an impeller 1 according to the present disclosure, wherein the same reference numbers indicate the same or equivalent parts and components already disclosed in connection to FIGS. 1 to 5. The front disk portion 3X of the hub 3 of the impeller 1 of FIG. 5A has a radial dimension RMED, which is not greater than a minimum inner radial dimension RS of the shroud 13.

In this embodiment, the first blade edges 7, or their projections on a meridian plane, are inclined with respect to the axial direction, i.e. with respect to the rotation axis A-A of the impeller 1. The first blade edges 7 lie on a conical surface co-axial to the rotation axis A-A of the impeller 1. The angle formed by the projection of the blade edge 7 on the meridian plane with respect to the axial direction is indicated with reference a in FIG. 5A. The angle $\alpha$ corresponds to half the angle at the vertex of the conical surface, whereon the first blade edges 7 are located. In some embodiments, the angle $\alpha$ can be more than 0° and les s than about 60°, for instance between about 0° and about 50°, in some embodiments between about 0° and about 45°, or more in some embodiments between about 0° and about 30°. In the embodiment of FIG. 5A the angle $\alpha$ is about 30°.

Even though a less effective improvement of the natural frequencies of the impeller, and of the rotor formed by a plurality of such impellers stacked one to the other, can be expected in this case, a simpler manufacturing can be obtained, as will be described in greater detail later on.

As shown in FIG. 5A, in this exemplary embodiment the outwardly oriented inlet surface vector Vi has a first radial component Vi1 and a second axial component Vi2. The radial component Vi1 is oriented outwardly with respect to the flow vane 11 and is orthogonal to the rotation axis A-A of the impeller 1. The outlet surface vector Vo has only a radial component in this embodiment.

In other embodiments, the second blade edges 9 can be located on a conical surface, similarly to the first blade edges 7, forming an angle with the rotation axis A-A of the impeller 1 which can be of the same magnitude as described above in connection with angle $\alpha$. In this case, the outlet surface vector Vo will have a radial, outwardly oriented vector component and an axial component.

Also in the embodiment of FIG. 5A, similarly to the embodiment of FIGS. 1 to 5, and differently from the impellers of the current art, the impeller 1 has a front disk portion 3X having a radial dimension RMED which is larger than the minimum radial dimension Rmin of the hub 3 in an intermediate position between the front disk portion 3X and the back disk portion 3Y of the hub 3. Moreover, the first blade edges 7 are located between the front disk portion 3X of the hub 3 and the shroud 13, at a radial distance from the rotation axis A-A such that a first portion of each flow vane 11 extend radially inwardly from the relevant first blade edges 7 towards the rotation axis A-A. The second blade edges 9 are arranged, in a manner similar to current art impellers, between the shroud 13 and the back disk portion 3Y of the hub 3, such that a radially extending second portion of each flow vane 11 is provided between the intermediate position of minimum radial dimension of the hub 3 and the second edges 9.

Thus, each flow vane 11 has opposite end portions, both at the inlet as well as at the outlet thereof, which extend in a radial direction from the rotation axis A-A towards the first blade edges 7 and the second blade edges 9, respectively.

In case of a centrifugal impeller, the fluid flows through each flow vane 11 from the inlet thereof at the first blade edges 7 towards the outlet at the second blade edges 9, entering the flow vanes 11 with a flow direction which has a radially inwardly oriented speed component and exiting the flow vanes 11 in a radial direction.

According to other embodiments, the trailing edges 9 can be inclined over the axial direction defined by the rotation axis A-A, as known in so-called mixed, radial-axial compressors.

In the case of a centripetal machine, such as a centripetal expander or a centripetal turbine, the fluid flow is reversed, entering the flow vanes 11 at the second blade edges 9 (in this case the leading edges) and exiting the flow vanes 11 at the first blade edges 7 (in this case the trailing edges). The fluid thus flows in the most downstream portion of the flow vanes 11 with a speed having a radial, outwardly oriented speed component. The inlet surface of each flow vane 11 is in this case defined between the corresponding neighboring second blade edges 9, and the inlet surface vector is vector Vo, while the outlet surface is defined between respective first edges 7 and the outlet surface vector is vector Vi.

In the embodiments of FIGS. 1 to 5A the impeller 1 is provided with a single set of blades 5, extending along the entire flow path across the impeller 1, from the first edges 7 to the second edges 9. Intermediate blades (not shown) can be provided, which extend in some or all the flow vanes 11 for a portion thereof.

In other embodiments, different sets of blades can be provided, each extending for only a portion of the flow path across the impeller 1. FIGS. 6 to 10 illustrate an impeller 1 for a centrifugal or centripetal turbomachine, wherein a first set of blades 5A and a second set of blades 5B are arranged between the side surface 3S of the hub 3 and the shroud 13. In the exemplary embodiment of FIGS. 6 to 10, the first set of blades 5A and the second set of blades 5B contain the same number of blades.

The diameter RMED of the front disk portion 3X is smaller than the minimum inner diameter of the shroud 13, but larger than the minimum diameter Rmin of the hub 3. In other embodiments, the diameter RMED can be larger than the minimum inner diameter of the shroud 13, as illustrated in FIGS. 1-5.

Each blade 5A of the first set of blades extends from a first edge 7 at the inlet of the respective flow vane 11 (in case of a centrifugal turbomachine) to an intermediate second edge 9A, located in an intermediate position along the flow vane 11. Similarly, each blade 5B of the second set of blades extends from an intermediate edge 7A, in an intermediate position along the flow vane 11, to a second edge 9 at the outlet of the flow vane 11.

Similarly to the embodiments of FIGS. 1 to 5A, each flow vane 11 has end portions at the inlet and at the outlet of the impeller 1, in which the fluid flow has a radial speed component. In case of a centripetal turbomachine, the inlet of each flow vane 11 is located at respective first edges 7 of blades 5A and the flow vanes 11 have a first portion, defined between neighboring blades 5A, in which the working fluid flow has a centripetal speed component. At the outlet, located at second edges 9 of blades 5B the flow vanes 11 have a final portion, defined between neighboring blades 5B, in which the working fluid flow has a centrifugal speed component.

Conversely, in case of a centripetal turbomachine, the inlet of the flow vanes 11 is located at second edges 9 of blades 5B and the flow vanes 11 have a first portion, defined by blades 5B, in which the working fluid flow has a centripetal speed component. At the outlet, located at first edges 7 of blades 5A, the flow vanes 11 have a final portion, defined by blades 5A, in which the working fluid flow has a centrifugal speed component.

In the embodiment of FIGS. 6 to 10 inlet and outlet surfaces and relevant inlet surface vector Vi and outlet surface vector Vo orthogonal thereto can be identified in quite the same way as described in connection with FIG. 2 above. More specifically, referring to FIGS. 6 and 7, a planar inlet surface spanning between two neighboring first edges 7 can be defined. A geometrical inlet surface vector Vi, orthogonal to the inlet surface and oriented outwardly with respect to the flow vane 11 can also be identified for each flow vane inlet. Since in the embodiment of FIGS. 6 to 10 the first edges 7 are located on a conical surface coaxial to the rotation axis A-A of the impeller 1, the inlet surface vector Vi has a radial component Vi1 and an axial component Vi2. The radial component Vi1 is oriented radially outwardly of the flow vane 11 and is orthogonal to the rotation axis A-A of the impeller 1.

Figure 6:
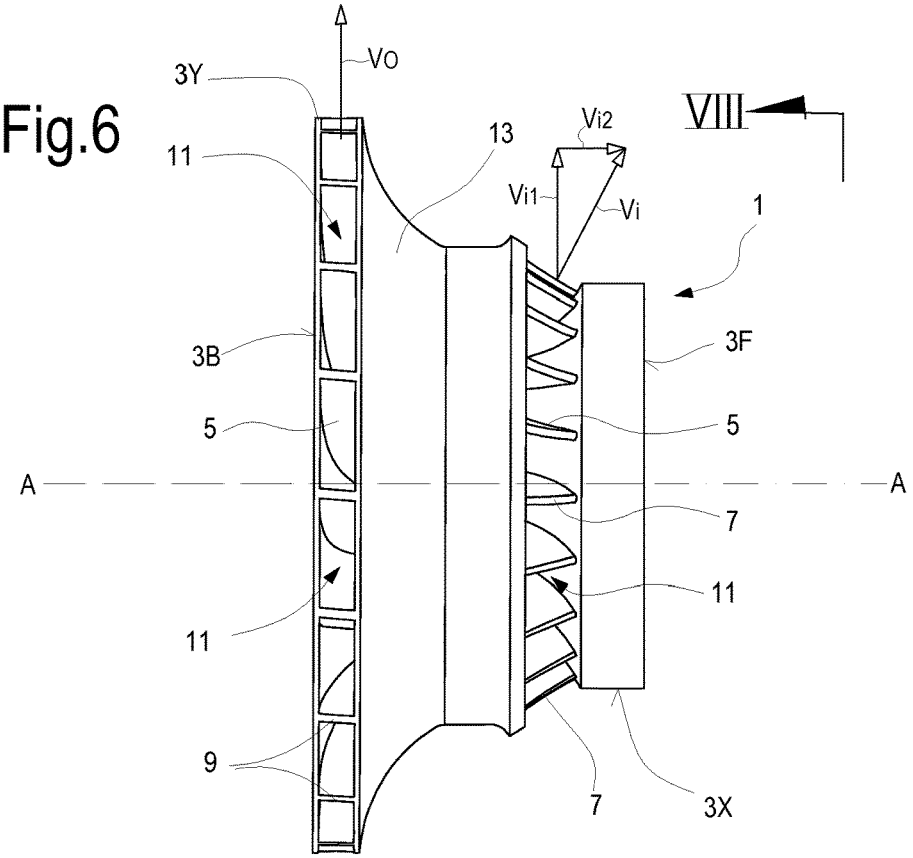
FIG. 6 illustrates a side view of a further exemplary embodiment of an impeller according to the present disclosure.
Figure 7:
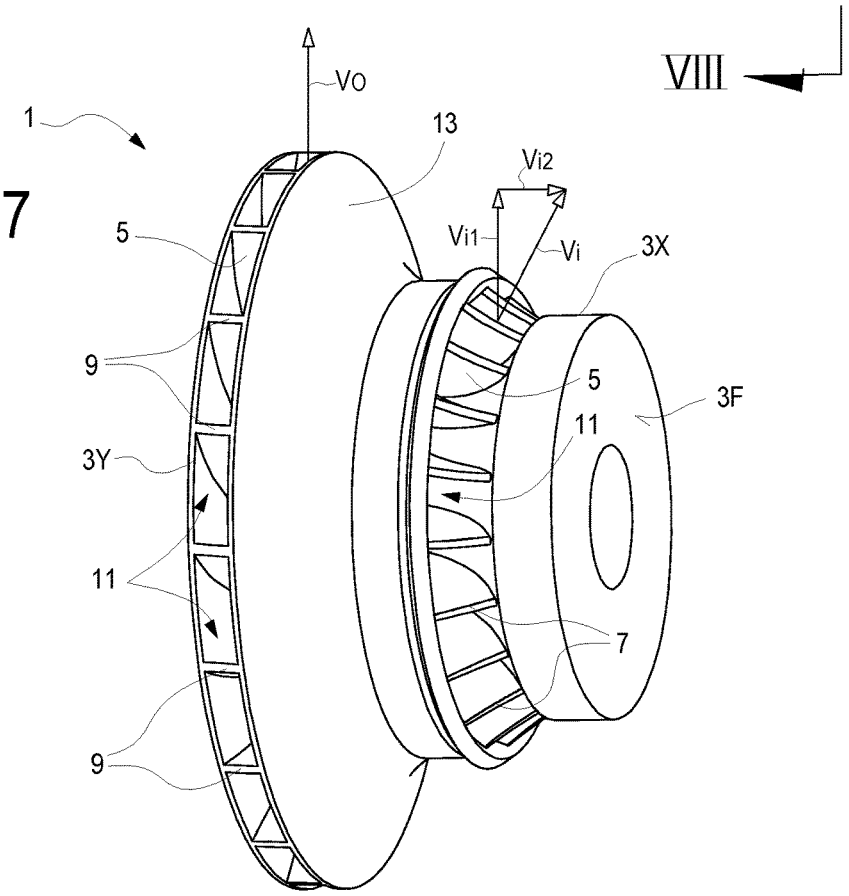
FIG. 7 illustrates an axonometric view of the impeller of FIG. 6.
Figure 8:
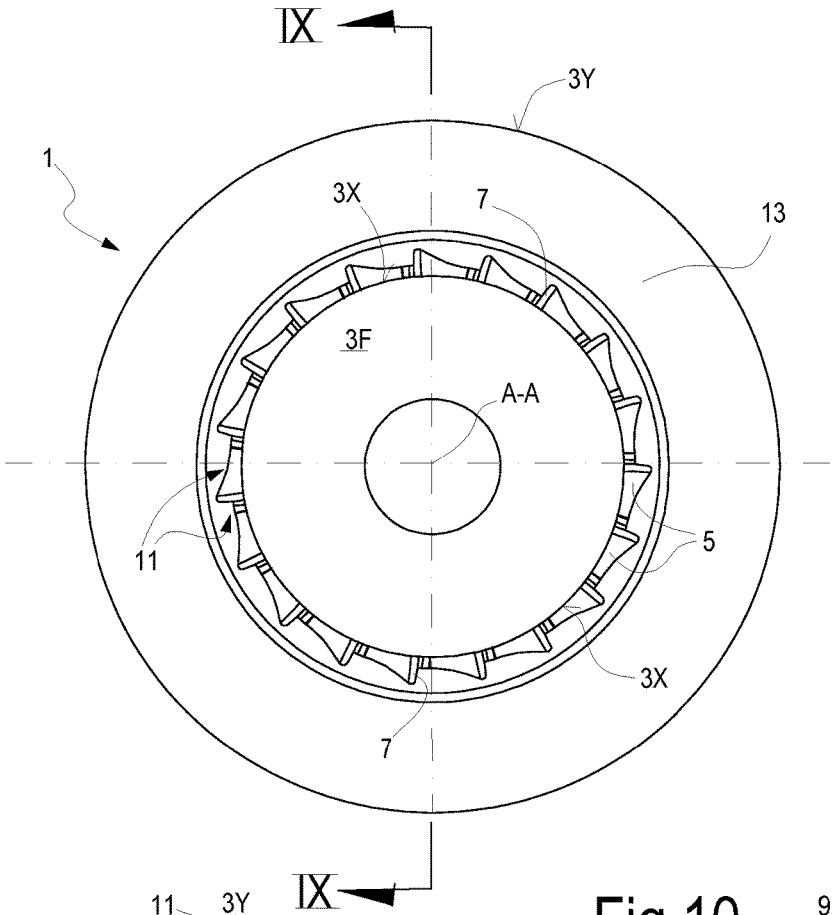
FIG. 8 illustrates a front view according to line VIII-VIII of FIG. 6.
Figure 9:
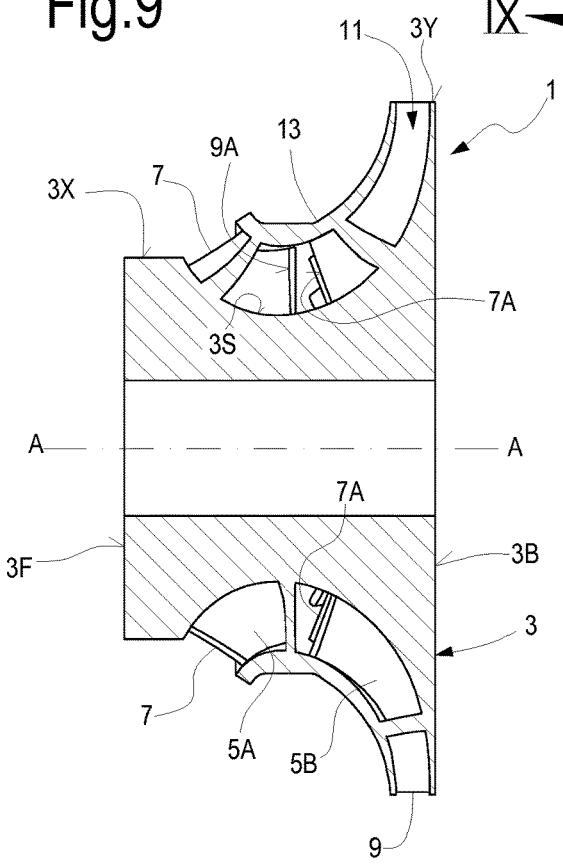
FIG. 9 illustrates a sectional view according to line IX-IX of FIG. 8.
Figure 10:
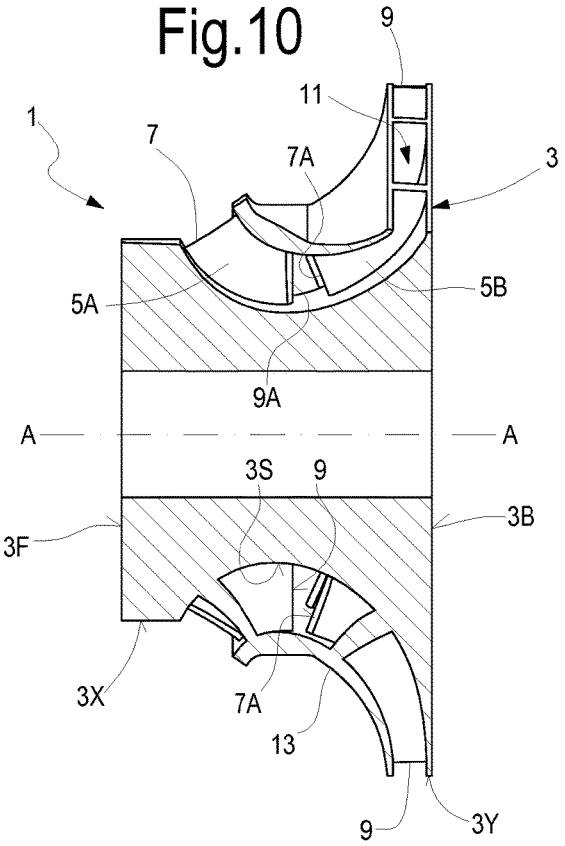
FIG. 10 illustrates a further sectional view similar to FIG. 9.
Figure 13:
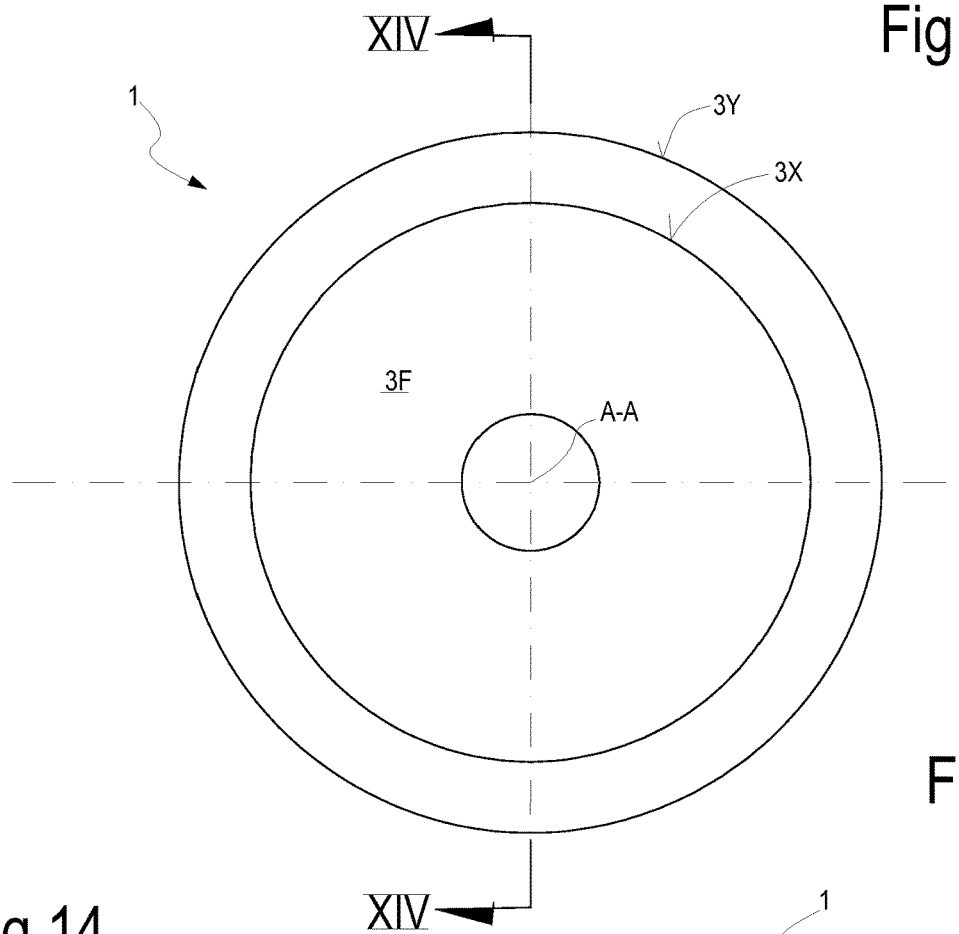
FIG. 13 illustrates a front view according to line XIII-XIII of FIG. 11.
Figure 14:
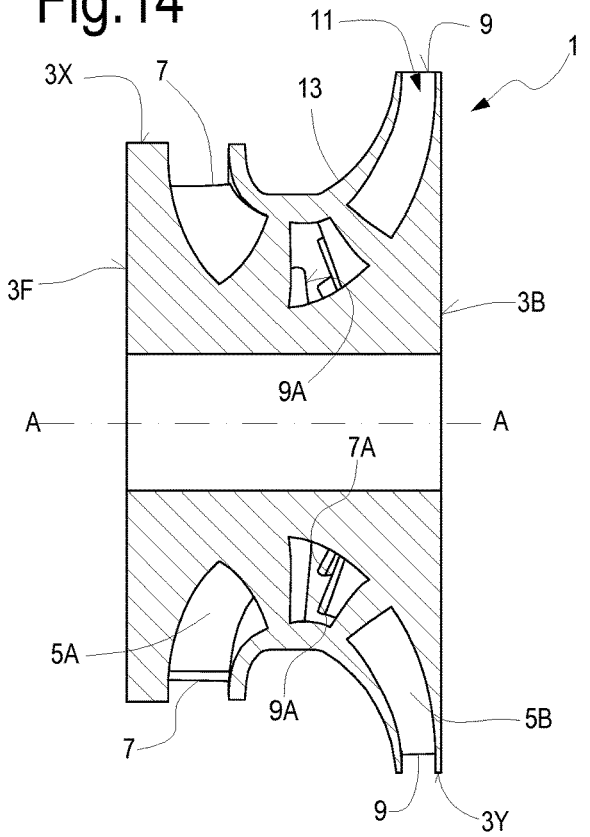
FIG. 14 illustrates a sectional view according to line XIV-XIV of FIG. 13.
Figure 15:
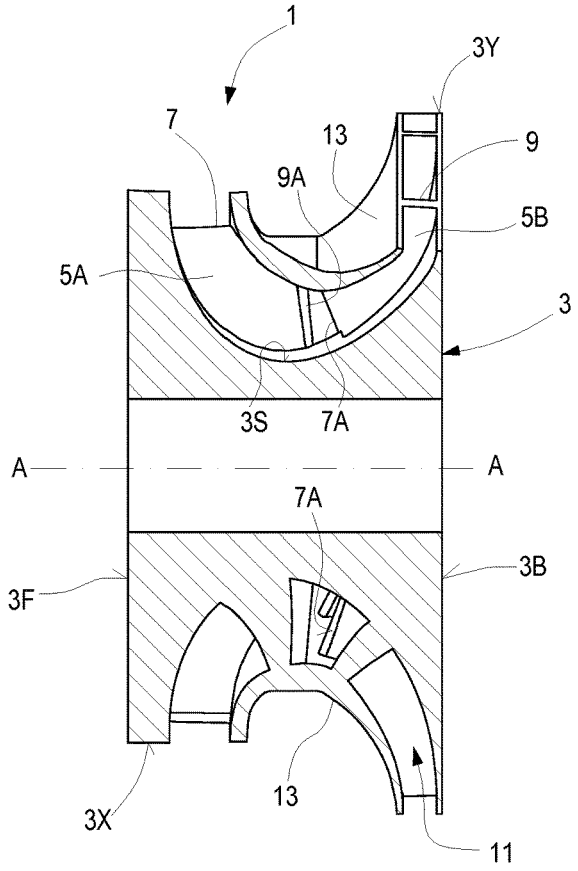
FIG. 15 illustrates a sectional view similar to FIG. 14.

Similarly, still referring to FIGS. 6 and 7, at the opposite end of the flow vanes 11, an outlet surface can be defined as a geometrical surface spanning between two neighboring second edges 9 defining the respective flow vane outlet. If the second edges 9 are rectilinear, the outlet surface can be planar. An outlet surface vector Vo orthogonal to the outlet surface and oriented outwardly with respect to the flow vane 11 can be defined, having in this embodiment only a radial, outwardly oriented component, orthogonal to the rotation axis A-A of the impeller 1.

As already mentioned previously, if the inlet and/or outlet surfaces are not planar, the inlet surface vector and the outlet surface vector can be defined with respect to a plane tangent to the inlet surface and outlet surface, respectively, in a central point thereof.

FIGS. 11-15 illustrate a further embodiment of an impeller 1 according to the present disclosure. The same reference numbers designate the same or equivalent components and parts, as already disclosed in FIGS. 1 to 10. In this embodiment, the radial dimension RMED of the front disk portion 3X is the same as the outer radial dimension of the shroud 13 at the front end thereof, and the blade edges 7 are located on a cylindrical surface. According to other embodiments (not shown), the radius RMED can be smaller and the blade edges 7 can be located on a conical surface, as shown in FIGS. 5A and 6-10.

Similarly to the embodiment of FIGS. 6-10, the impeller 1 of FIGS. 11-15 has two sets of blades 5A, 5B. However, differently from the previously described embodiment, the two sets of blades have a different number of blades. More specifically, in the impeller of FIGS. 11-15 the first set of blades 5A has a smaller number of blades than the second set of blades 5B.

Also in the embodiment of FIGS. 11-15 inlet and outlet surfaces can be identified at each flow vane inlet and outlet, respectively, the inlet and outlet surfaces having a respective inlet surface vector and outlet surface vector orthogonal thereto, facing outwardly with respect to the flow vanes 11, quite in the same way as vectors Vi and Vo described in connection with FIGS. 1 to 10. These vectors, each has a vector component which is radially oriented, i.e. orthogonal to the rotation axis A-A of the impeller 1, and oriented outwardly with respect to the flow vane 11.

A turbomachine can include a single impeller 1. However, the above described impeller structure is particularly advantageous if used in a multi-stage turbomachine, wherein a plurality of impellers 1 are assembled to form a rotor.

According to some embodiments, the impellers 1 can be keyed on a rotating shaft and be supported thereby for rotation.

In other embodiments, the impellers can be directly coupled to one another to form a stack. In some embodiments, no shaft is provided, and the impellers form themselves an axial supporting structure.

The impellers can be stacked to one another and torsionally coupled to one another, e.g. by soldering, welding, or brazing. In other embodiments, the impellers can be torsionally coupled by a mechanical coupling, such as by means of a Hirth coupling.

Each impeller 1 can be manufactured for instance by means of an additive manufacturing method. The hub 3, the blades 5, 5A, 5B and the shroud 13 can thus be manufactured as a monolithic component, by depositing successive layers of metal powder. Each metal powder layer is melted by means of a source of energy, such as an electron beam source or laser beam source, according to a pattern corresponding to the corresponding cross section of the impeller. Successive layers of partly melted metal powder solidify in a single monolithic final impeller.

According to other embodiments, manufacturing of the impeller 1 can be by milling or other machining process.

In some embodiments, the hub 3 and the blades 5, 5A, 5B on the one side and the shroud 13 on the other can be manufactured separately and assembled afterwards. The shroud 13 must in this case be mounted coaxially to a unit comprised of the hub 3 and the blades 5; 5A, 5B. This requires the front disk portion 3X of the hub 3 to have a diametrical dimension smaller than the minimum inner diametrical dimension of the shroud 13, as illustrated by way of example in FIGS. 5A, 6-10. The shroud 13 is then connected to the blades 5 along the blade tips, e.g. by soldering or welding. The shroud 13 and the hub and blades unit 3, 5, 5A, 5B can each be manufactured by means of any suitable process, e.g. by additive manufacturing, or by milling, or any other stock removal method.

Figure 18:
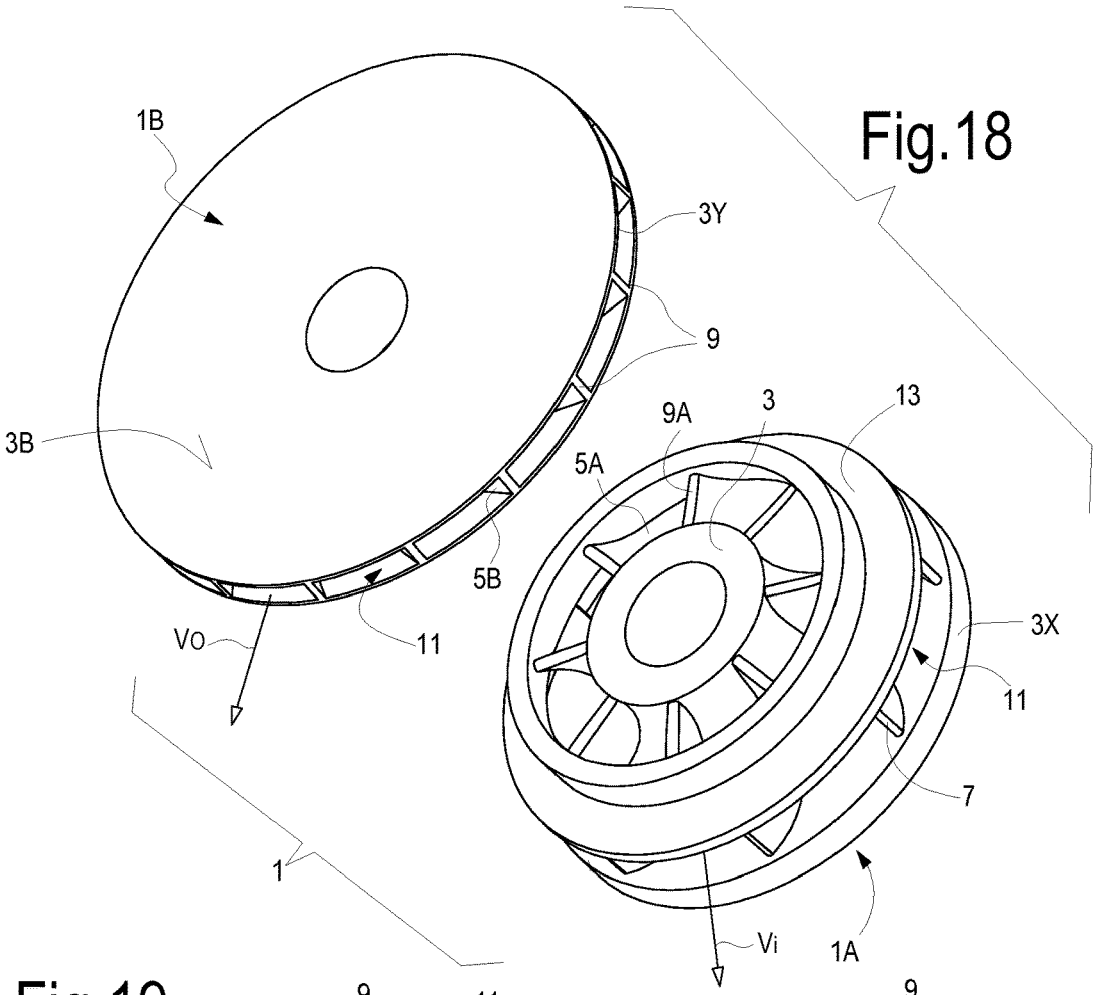

FIGS. 16 to 18 illustrate a further embodiment of an impeller 1 according to the present disclosure. The impeller 1 is formed by two impeller sections 1A, 1B. In FIGS. 16 to 18 the two impeller sections 1A, 1B are shown in a disassembled condition. The impeller sections 1A, 1B can be assembled for example by welding, soldering or brazing, or in any other suitable manner. In some embodiments, impeller sections 1A, 1B of a plurality of impellers 1 are stacked and torsionally and axially coupled to one another by means of a central shaft and front toothing, e.g. a Hirth toothing, provided at the surfaces of mutual contact between the stacked impeller sections 1A, 1B.

Once assembled, the impeller 1 formed by the two impeller sections 1A, 1B is substantially the same as the impeller 1 of FIGS. 11-15, and is comprised of a hub 3 with a front disk portion 3X and a back disk portion 3Y. Two sets of blades 5A, 5B are provided. The set of blades 5A are formed on the first impeller section 1A, while the set of blades 5B are formed on the second impeller section 1B. In the embodiment illustrated in FIGS. 16 to 18 the first set of blades 5A comprises half the number of blades of the second set of blades 5B. In other embodiments, the same number of blades can be provided in the two sets of blades 5A, 5B.

In FIG. 17 inlet surface vector Vi and outlet surface vector Vo having a radial direction orthogonal to the rotation axis A-A and facing outside the flow vane 11 are shown.

Figure 19:
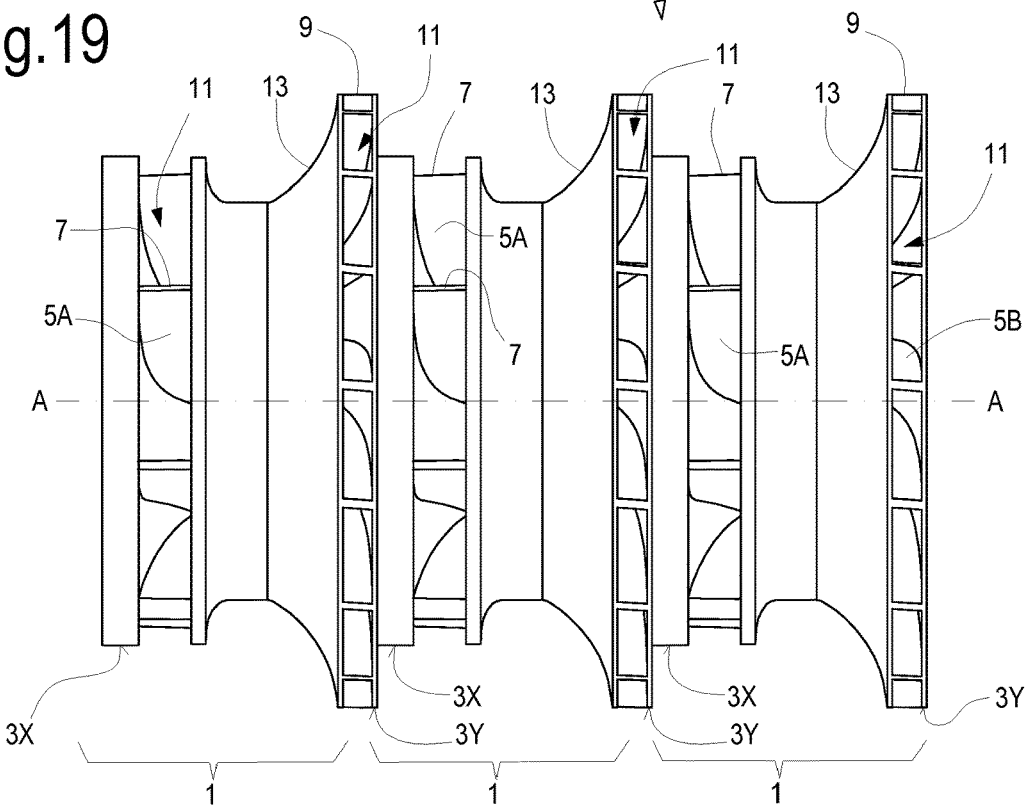
FIG. 19 illustrates a turbomachine rotor formed by three impellers according to FIGS. 16-18 assembled together forming a single rotating component.

FIG. 19 illustrates an exemplary embodiment of a rotor 31 formed by a set of three impellers 1, connected one to the other and coaxial to a rotation axis A-A. Each impeller 1 is configured as the impeller of FIGS. 11-18. It shall be understood that impellers 1 according to the embodiments of FIGS. 1-10 can be assembled to form a rotor 31 in quite the same manner.

Neighboring impellers 1 are coupled at an interface formed by mutually facing back disk portion 3Y of one impeller and front disk portion 3X of the other impeller. The large cross section of the rotor at the interface of neighboring impellers renders the rotor 31 stiffer than the rotors of the current art.

Figure 20:
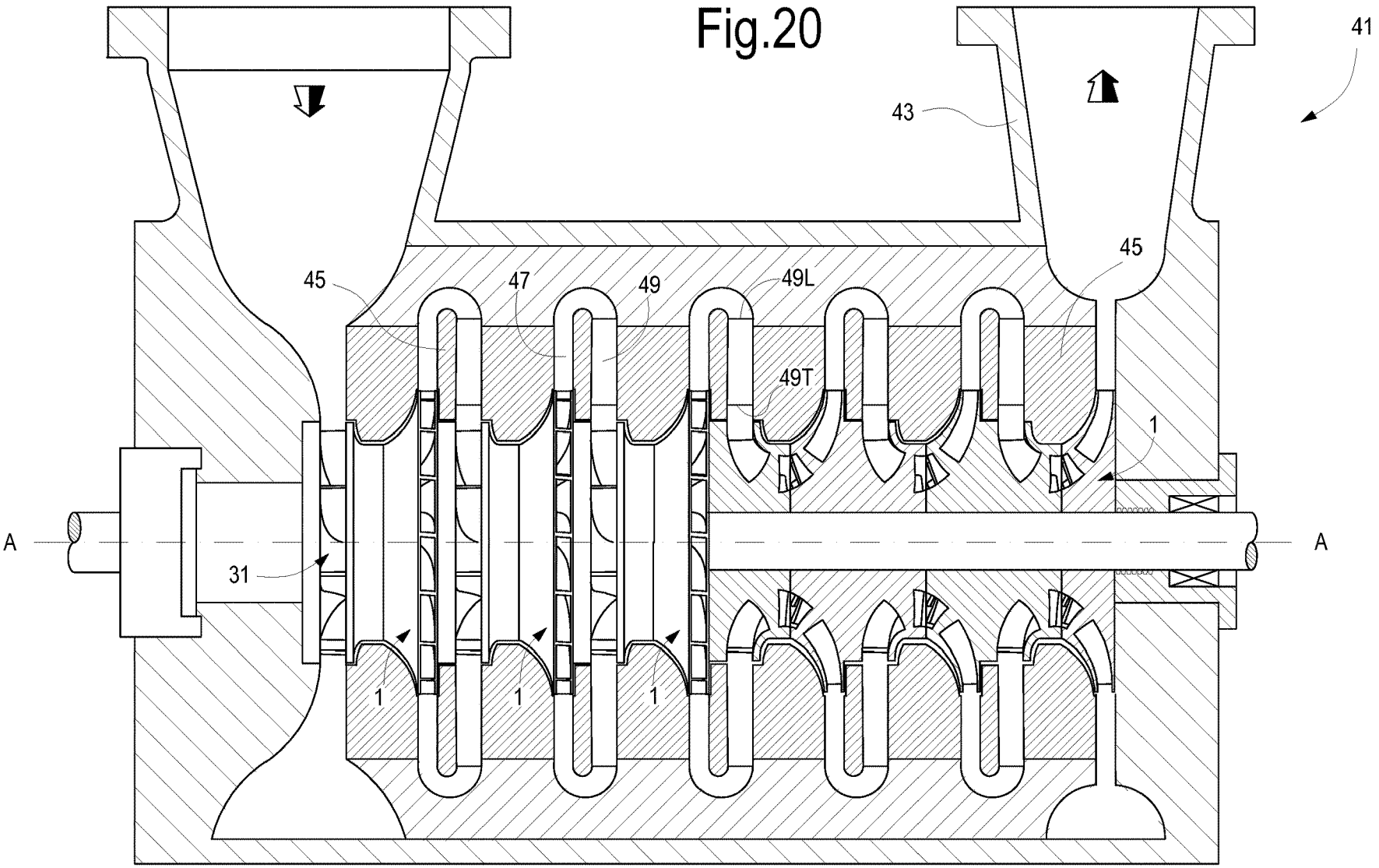
FIG. 20 illustrates a portion of a centrifugal compressor, comprising a rotor formed by impellers according to the present disclosure.

The rotor 31 can be mounted for rotation in a stationary casing 43 of a turbomachine 41, as schematically shown in FIG. 20. The stationary casing 43 contains diaphragms 45 forming the stationary components of the turbomachine 41. Diffusers 47 and return channels 49 are formed by the diaphragms 45 of the turbomachine 41. Diffusers and return channels, as well as the inlet and outlet manifolds of the turbomachine 41, as well as other components thereof can be designed in quite the same manner as in machines of the current art. The return channels 49 are provided with stationary return channel blades arranged therein. As shown in FIG. 20, each return channel blade has a leading edge 49L and a trailing edge 49T. The trailing edges 49T of the return channel blades face the first blade edges 7 of the subsequent impeller 1, such that the flow vane inlets of the impeller 1 arranged downstream of a return channel 49 face the trailing edges 49T of the return channel blades.

Figure 21:
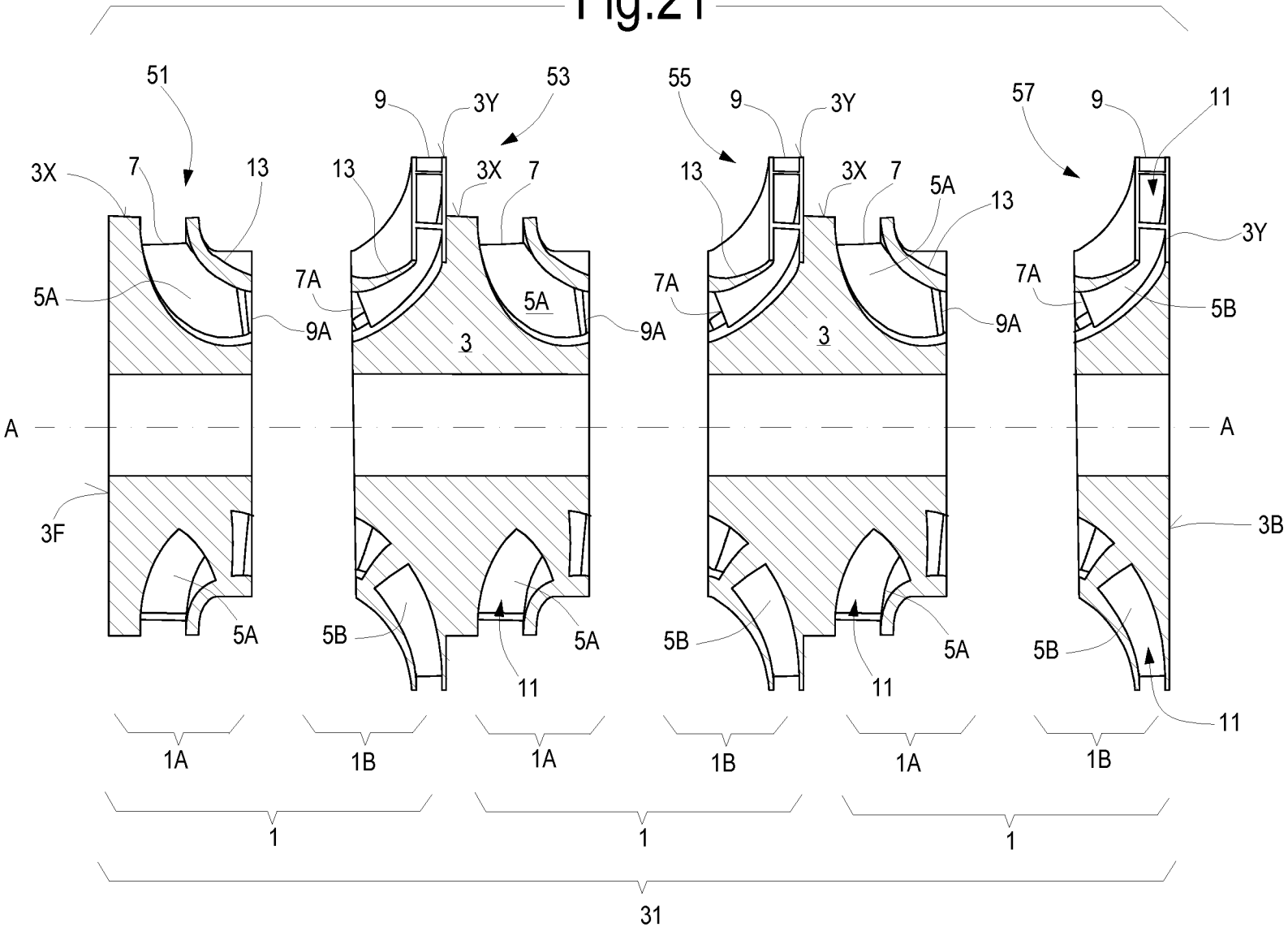
FIG. 21 illustrates a sectional view of a different way of assembling a multi-stage rotor including impellers according to the present disclosure.

While in the above described embodiments each impeller 1 of rotor 31 is either formed by a single element, or by two or more elements assembled to one another, in other embodiments the rotor 31 can be comprised of rotor sections, each of which can belong partly to a first impeller and partly to a second impeller, the first and second impellers being arranged one after the other in the direction of flow of the fluid processed by the rotor. FIG. 21 illustrates a configuration of this kind, wherein the rotor sections are shown separated from one another, i.e. prior to assembling the rotor 31.

In the exemplary embodiment of FIG. 21, a rotor 31 including three impellers 1 is illustrated. It shall, however, be understood that a different number of impellers 1 can be provided. The rotor 31 is formed by four rotor sections labeled 51, 53, 55, 57. The two intermediate rotor sections 53, 55 are substantially similar to one another.

The first rotor section 51 is substantially configured as the impeller section 1A of FIGS. 16-18. The last rotor section 57 is substantially configured as the impeller section 1B of FIGS. 16-18. Each one of the two intermediate sections 53, 55 is formed by an impeller section 1B and by an impeller section 1A, respectively. The rotor sections 51, 53, 55, 57 are coupled to one another thus forming a rotor 31. Coupling can be obtained by welding, for instance. In other embodiments the rotor sections 51, 53, 55, 57 can be stacked to one another and axially locked by means of a central shaft, not shown. Torsional connection between the rotor sections can be obtained by front toothing, such as a Hirth toothing of Hirth coupling.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbomachine impeller with a rotation axis, the turbomachine impeller comprising:

a hub;

a shroud;

a plurality of blades arranged between the hub and the shroud; and a plurality of flow vanes defined between the hub, the shroud and neighboring blades, each of the plurality of flow vanes comprising a flow vane inlet located between respective first blade edges of two neighboring blades of the plurality of blades and a flow vane outlet located between respective second blade edges of two neighboring blades of the plurality of blades and, wherein an inlet surface is defined between the first blade edges and an outlet surface is defined between the second blade edges, wherein an inlet surface vector, orthogonal to the inlet surface and oriented outwardly with respect to each flow vane of the plurality of flow vanes, has an outwardly oriented vector component which is orthogonal to the rotation axis, and an outlet surface vector, orthogonal to the outlet surface and oriented outwardly with respect to each flow vane of the plurality of flow vanes, has an outwardly oriented vector component which is orthogonal to the rotation axis and; the hub comprises a front disk portion, a back disk portion and an intermediate hub portion extending therebetween, the intermediate hub portion defining a minimum radial dimension smaller than a respective radial dimension of the front disk portion and the back disk portion, and the plurality of blades are arranged between the front disk portion and the back disk portion.

2. The turbomachine impeller of claim 1, wherein each of the plurality of flow vanes is configured and arranged such that fluid flow at the flow vane inlet has a radially inwardly oriented flow speed component and fluid flow in the flow vane outlet has a radially outwardly oriented flow speed component.

3. The turbomachine impeller of claim 1, wherein each of the plurality of flow vanes extends beyond the intermediate hub portion between the front disk portion and the shroud.

4. The turbomachine impeller of claim 1, wherein each of the plurality of flow vanes extends beyond the intermediate hub portion between the back disk portion and the shroud.

5. The turbomachine impeller of claim 1, wherein the shroud comprises a shroud portion of a minimal radial dimension, and the respective radial dimension of the back disk portion and/or the front disk portion is not larger than the minimum radial dimension of the shroud portion.

6. The turbomachine impeller of claim 1, wherein the first blade edges at the flow vane inlet are oriented such that projections thereof on a meridian plane of the impeller form an angle between 0° and 60° with a direction of the rotation axis, and the second blade edges at the flow vane outlet are oriented such that projections thereof on the meridian plane form an angle between 0° and 60° with the direction of the rotation axis.

7. The turbomachine impeller of claim 1, wherein each blade of the plurality of blades extends from the flow vane inlet to the flow vane outlet.

8. The turbomachine impeller of claim 1, wherein the plurality of blades comprise a first set of blades and a second set of blades; each blade of the first set of blades extends from a respective first edge at the flow vane inlet to a respective intermediate second edge located in an intermediate position along a respective flow vane of the plurality of flow vanes, and each blade of the second set of blades extends from a respective intermediate first edge along a respective flow vane of the plurality of flow vanes to a second edge at the flow vane outlet.

9. The turbomachine impeller of claim 1, further comprising a first impeller section and a second impeller section torsionally and axially coupled to one another, wherein one of the first impeller section and the second impeller section comprises the flow vane inlets and the other of the first impeller section and the second impeller section comprises the flow vane outlets.

10. A turbomachine comprising: a casing; and at least a first impeller according to claim 1 supported for rotation in the casing.

11. The turbomachine of claim 10, further comprising at least a second impeller supported for rotation in the casing and arranged in series with the first impeller.

12. The turbomachine of claim 11, wherein further comprising a diffuser and a return channel arranged between the first impeller and the second impeller, the return channel comprising stationary return channel blades, each stationary return channel blade having a leading edge and a trailing edge, wherein flow vane inlets of the second impeller face the trailing edges of the return channel blades.

13. The turbomachine of claim 11, wherein the first impeller and the second impeller are formed by sequentially arranged impeller sections, at least one of the impeller sections forming part of the first impeller and part of the second impeller.

14. The turbomachine impeller of claim 6, wherein the second blade edges at the flow vane outlet are oriented such that the projections thereof on the meridian plane form an angle between 0° and 30°, with the direction of the rotation axis.

15. The turbomachine impeller of claim 6, wherein the second blade edges at the flow vane outlet are oriented such that the projections thereof on the meridian plane form an angle between about 0° and about 45° with the direction of the rotation axis.

* * * * *